US009257779B2

(12) United States Patent
Tamai et al.

(10) Patent No.: US 9,257,779 B2
(45) Date of Patent: Feb. 9, 2016

(54) INTERMEDIATE CONNECTION ELECTRICAL CONNECTOR

(71) Applicant: Hirose Electric Co., Ltd., Tokyo (JP)

(72) Inventors: Nobuhiro Tamai, Tokyo (JP); Toshiyuki Takada, Tokyo (JP); Kunia Aihara, Santa Clara, CA (US); Jeremy Huang, Santa Clara, CA (US); Masakazu Nagata, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 14/225,467

(22) Filed: Mar. 26, 2014

(65) Prior Publication Data

US 2014/0295702 A1 Oct. 2, 2014

(30) Foreign Application Priority Data

Mar. 29, 2013 (JP) ..... 2013-071526

(51) Int. Cl.

| | |
|---|---|
| ***H01R 13/648*** | (2006.01) |
| ***H01R 13/518*** | (2006.01) |
| ***H01R 13/6598*** | (2011.01) |
| ***H01R 31/06*** | (2006.01) |

(52) U.S. Cl.

CPC ..... *H01R 13/518* (2013.01); *H01R 13/6598* (2013.01); *H01R 31/06* (2013.01)

(58) Field of Classification Search

CPC . H01R 13/518; H01R 31/106; H01R 13/6598
USPC ..... 439/607.01
See application file for complete search history.

(56) References Cited

U.S. PATENT DOCUMENTS 8,741,419 B2 * 6/2014 Gamo et al. ..... 428/172
2008/0251009 A1 * 10/2008 Nagai et al. ..... 118/35

FOREIGN PATENT DOCUMENTS

JP 2008-545250 A 12/2008

* cited by examiner

*Primary Examiner* — Jean F Duverne
(74) *Attorney, Agent, or Firm* — Kubotera & Associates, LLC

(57) ABSTRACT

An intermediate connection electrical connector includes a plurality of blades and a supporting member for supporting the blades arranged in an arrangement direction. The supporting member includes a surrounding wall portion for surrounding the blades and a regulating portion for positioning the blades. The surrounding wall portion includes a side wall portion and an edge wall portion. The side wall portion is at least partially formed of an electromagnetic wave absorbing material. The regulating portion is disposed inside the surrounding wall portion to define a blade accommodating space for accommodating the blades.

9 Claims, 12 Drawing Sheets

INTERMEDIATE CONNECTION ELECTRICAL CONNECTOR

BACKGROUND OF THE INVENTION AND RELATED ART STATEMENT

The present invention relates to an intermediate connection electrical connector for connecting a mating connector or a circuit board as a relative connecting member. In particular, the present invention relates to an intermediate connection electrical connector suitable for transmitting a signal at a high speed (a high frequency).

A conventional intermediate connection electrical connector includes a plurality of blades, in which a plurality of terminals is arranged as a terminal group in a high density on a surface of a flat substrate formed of an electrical insulating member. The blades are arranged at a certain interval in a thickness direction thereof. Further, the conventional intermediate connection electrical connector includes a housing for holding the blades. In each blade, contact sections of the terminal group are positioned on a side of one end and a side of the other end thereof, so as to be capable of connecting to respective mating connecting members.

For example, Patent Reference discloses a conventional intermediate connection electrical connector for connecting a mating connector (a backplane connector) and a circuit board (a daughter card). The conventional intermediate connection electrical connector has a plurality of blades, which are referred to as "wafers" having rectangular flat shapes. On each blade, contact sections on a side of one end (a side to be connected to the mating connector) of the terminal group are arranged on one side thereof, and the contact sections on a side of the other end of the terminal group (the side to be connected to the circuit board) are arranged on another side thereof that is perpendicular to the one side. The blades are used as pair terminals whereby two adjacent terminals transmit differential signals.

Patent Reference: Japanese Patent Publication of Translated Version No. 2008-545250

In the conventional intermediate connection electrical connector disclosed in Patent Reference, in each blade, between the contact sections of the pair terminals, i.e., between the two adjacent contact sections and the next adjacent contact sections, there is formed a cavity, and a lossy insert is attached thereto. The lossy insert disclosed in the Patent Reference is made of an electrically lossy material (an electromagnetic wave-absorbing material). Such an electrically lossy material is a conductor as a whole, but is a relatively poor conductor relative to a specific frequency. Therefore, the lossy insert absorbs unnecessary electromagnetic waves (a noise) coming from each other, so that the terminals located on both sides of the lossy insert are shielded from the noise, thereby preventing so-called "crosstalk" between the terminals. Such an electrically lossy material may be obtained, for example, by adding filler containing conductive particles to a binder.

According to Patent Reference, the lossy insert is provided between the contact sections of the pair terminals and the contact sections of the adjacent pair terminals. Accordingly, it is possible to prevent the crosstalk at the contact sections between the pair terminals of the blade.

According to Patent Reference, the mating connector accommodates a portion of each blade on a side of one end (a part on which one ends of the terminal group is located) while being in a state that a plurality of blades is arranged in the blade thickness direction. Further, the mating connector is connected to the connecting sections on a side of one ends of the terminals group of the blade. In addition, the mating connector has a grounding plate (a shielding plate) having a flat surface thereof perpendicular to the plate thickness direction, and is configured to be connected to the lossy insert of the blade.

As described above, according to Patent Reference, the lossy insert for preventing the crosstalk is attached to the blade. Accordingly, it is possible to prevent the crosstalk between the contact sections of the two adjacent pair terminals within the blade.

However, in the conventional intermediate connection electrical connector, the lossy insert is not provided between the blades, and further the lossy insert is not provided at a position on the mating connector corresponding to a position between the blades. In other words, before and after connecting the conventional intermediate connection electrical connector and the mating connector, there is no lossy insert present between the blades.

In addition, the mating connector has the grounding plate at a position corresponding to a position between the blades. Accordingly, in a state that the conventional intermediate connection electrical connector is connected to the mating connector, the unnecessary electromagnetic waves irradiated from the terminals of each blade tend to be transferred onto the grounding plate. As a result, resonance sometimes occurs between the grounding plates that are adjacent to each other, and the resonance could be picked up as the noise by the terminal of another blade adjacent thereto.

In order to solve the problems of the conventional intermediate connection electrical connector described above, an object of the present invention is to provide an intermediate connection electrical connector capable of significantly reducing the resonance between grounding sections.

Further objects and advantages of the present invention will be apparent from the following description of the present invention.

SUMMARY OF THE INVENTION

In order to attain the objects described above, according to a first aspect of the present invention, an intermediate connection electrical connector includes a plurality of blades, which is arranged in a direction perpendicular to a surface of terminals thereof and is supported by a support member. Each blade is formed to have a plurality of terminals, which is arranged in a strip form between contact sections or connecting sections formed on a side of one end and a side of the other end thereof. The terminals and grounding sections are disposed on a substrate member.

According to the intermediate connection electrical connector of the present invention, the support member has a circumferential wall section, which is composed of two side wall sections that face each other and extend in the blade arrangement direction and two end wall sections that joins the two side wall sections so as to surround the plurality of blades. The support member further includes restricting sections for positioning each blade in a certain range in the arrangement direction. At least, a part of the side wall sections is formed of an electromagnetic absorbing material. The support member has blade accommodating spaces for inserting the blades towards specified positions in an insertion direction that is a direction that connects the side of one end and the side of the other end, and the blade accommodating spaces are formed to penetrate in the insertion directions.

According to the present invention, at least a part of the support member is made of an electromagnetic absorbing material. Accordingly, even when unnecessary electromagnetic waves irradiated from the terminals of the blades propagate to the grounding sections of the blades, such unnecessary electromagnetic waves are absorbed by the electromagnetic wave-absorbing material of the support member and attenuated. Therefore, it is possible to prevent generation of resonance between the grounding sections that are adjacent to each other. Further, even when such resonance occurs, it is possible to significantly reduce the resonance. As a result, it is possible to significantly reduce a level of noises picked up by the terminals of the adjacent other blade.

According to a second aspect of the present invention, a plurality of terminals may be arranged on one flat surface of a flat substrate, and a grounding plate may be provided as a grounding section on the other flat surface of the substrate.

According to a third aspect of the present invention, the blade accommodating spaces may be formed as slits, to which the blades can be inserted, so that dividing wall sections between adjacent slits may form restricting sections that can abut against surfaces of the corresponding blades.

According to a fourth aspect of the present invention, in the third aspect of the present invention, the slits of the support member may be formed at positions corresponding to those of the respective blades.

According to a fifth aspect of the present invention, it may be possible to configure such that two blades can be inserted in each slit.

According to a sixth aspect of the present invention, the support member may have thin protrusions as the restricting sections, which are groove section to which side edges of the respective blades can be inserted, on facing inner surfaces of the side wall sections of the circumferential wall section.

According to a seventh aspect of the present invention, when the grounding sections of the blades are made as grounding plates, the support member includes secondary grounding plates, which face the grounding plates of the respective blades, within the blade accommodating spaces, and the secondary grounding plates contact with the grounding plates of the blades by energizing force. Providing such secondary grounding plates, it is possible to enhance the grounding functions in the respective blades.

According to an eighth aspect of the present invention, the support member may also serve as a housing of the intermediate connection electrical connector.

According to a ninth aspect of the present invention, the support member can be formed as a guide to be accommodated within the housing.

According to a tenth aspect of the present invention, the support member may be integrally formed of an electromagnetic wave-absorbing material so as to include the surrounding wall section and the restricting sections as one member. Accordingly, the plurality of blades is surrounded by the electromagnetic wave-absorbing material and the electromagnetic wave-absorbing material is provided between the blades, so that it is possible to more securely absorb the unnecessary electromagnetic waves. Therefore, it is achievable to significantly reduce the resonance of the grounding sections and in turn the level of the noises picked up by terminals of other blades.

As described above, according to the present invention, a part of the side wall sections of the support member is made of the electromagnetic wave-absorbing material, and thereby the unnecessary electromagnetic waves irradiated from the terminals of the blades and propagated to the grounding sections of the blades are absorbed and attenuated by the electromagnetic wave-absorbing material. Therefore, it is achievable to prevent the resonance between the grounding sections that are adjacent to each other, and even when the resonance occurs, it is still possible to significantly reduce the resonance. As a result, it is possible to reduce the level of the noises picked up by the terminals of other adjacent blades from the grounding sections to zero or significantly reduce the level of such noises.

BRIEF DESCRIPTION OF THE DRAWINGS

FIGS. 4(A) and 4(B) are perspective views showing a blade of the intermediate connection electrical connector of according to the first embodiment of the present invention, wherein FIG. 4(A) is a perspective view showing a surface thereof on which terminals are arranged, and FIG. 4(B) is a perspective view showing an opposite surface thereof on which a grounding plate is disposed;

FIGS. 10(A) and 10(B) are perspective views showing an intermediate connection electrical connector according to a fifth embodiment of the present invention, wherein FIG. 10(A) is a perspective view showing an outer appearance of the intermediate connection electrical connector, and FIG. 10(B) is a perspective view showing the intermediate connection electrical connector without a frame member of an upper support member thereof;

DETAILED DESCRIPTION OF THE PREFERRED EMBODIMENTS

Hereunder, an embodiment of the present invention will be described with reference to the accompanying drawings.

First Embodiment

Figure 1:
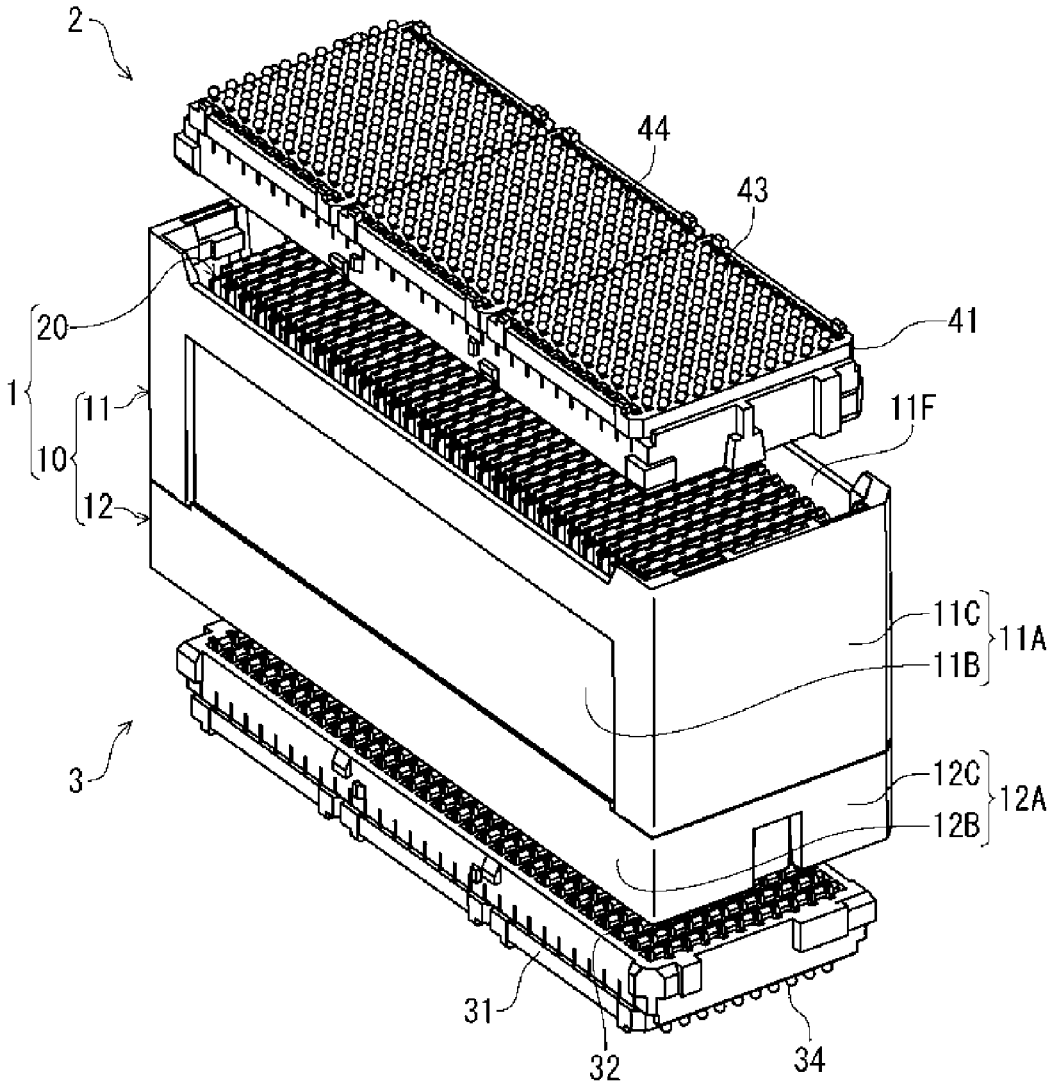
FIG. 1 is a perspective view showing an intermediate connection electrical connector and a mating connector thereof according to a first embodiment of the present invention.
Figure 2:
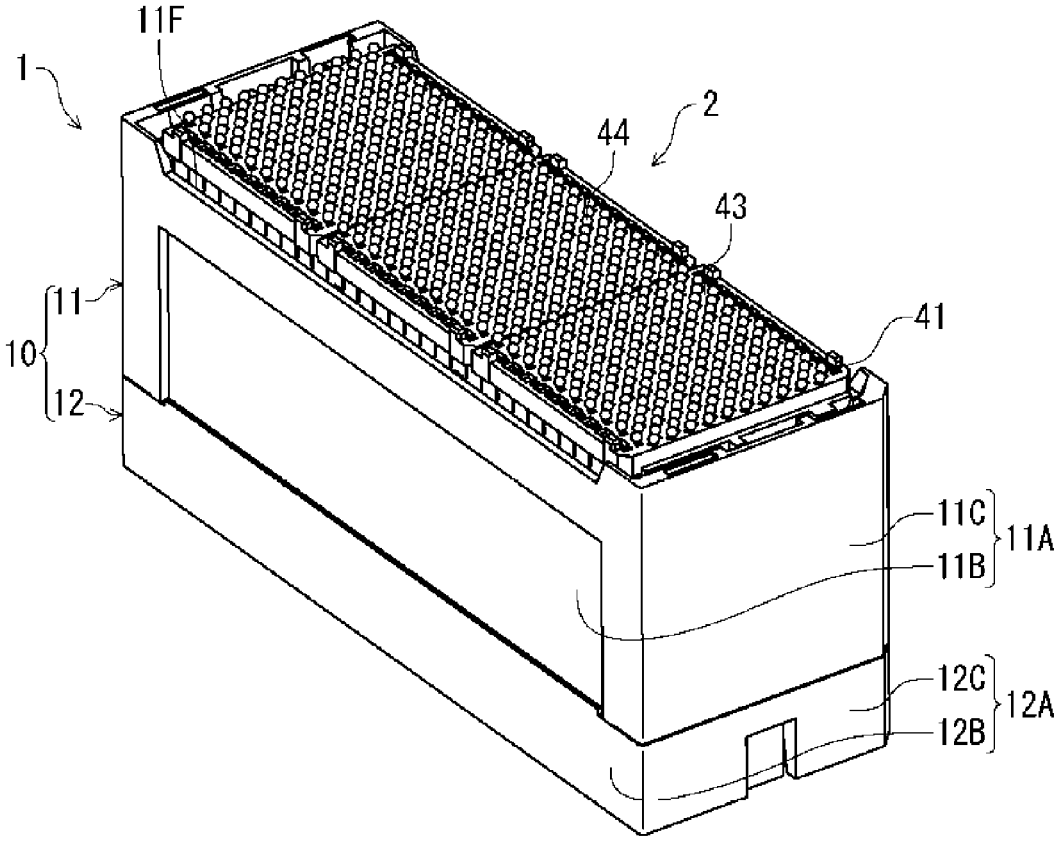
FIG. 2 is a perspective view showing the intermediate connection electrical connector and the mating connector in a connected state according to the first embodiment of the present invention.

FIG. 1 is a perspective view showing an intermediate connection electrical connector 1 according to a first embodiment and mating connectors 2 and 3 thereof in a state before fitting the mating connectors 2 and 3. FIG. 2 is a perspective view showing the intermediate connection electrical connector 1 and the mating connectors 2 and 3 of FIG. 1 in a state of being fitted to the mating connectors 2 and 3.

In the first embodiment, the intermediate connection electrical connector 1 (hereinafter, referred also to as "relay connector 1") used for transmitting high-speed signals. Fitting to the mating connectors 2 and 3 as mating connecting members, the relay connector 1 connects the mating connectors 2 and 3. More specifically, the mating connectors 2 and 3 are electrical connectors for circuit boards, which are respectively to be disposed on different circuit boards (not illustrated). A surface of each circuit board is respectively fitted to the relay connector 1, having the surface being perpendicular to the up-and-down direction. With the mating connector 2 is fitted to the relay connector 1 from thereabove and the mating connector 3 is fitted to the relay connector 1 from thereunder as described above, the mating connectors 2 and 3 are connected to each other via the relay connector 1 as shown in FIG. 2 (the mating connector 3 is not illustrated).

In the embodiment, the mating connectors 2 and 3 are configured as connectors having completely identical shapes to each other.

The relay connector 1 includes a plurality of flat blades 20 (refer to FIGS. 4(A) and 4(B)), which will be described later, and a support member 10, which is made of an electromagnetic wave-absorbing material and arranges and supports the plurality of blades 20 at certain intervals in a thickness direction of the blades 20. The support member 10 has generally rectangular outer shape with the arrangement direction of the blades 20 being a longitudinal direction thereof, and also serves as a housing. The support member 10 is configured by putting an upper support member 11 and a lower support member 12 together in the up-and-down direction.

Figure 3:
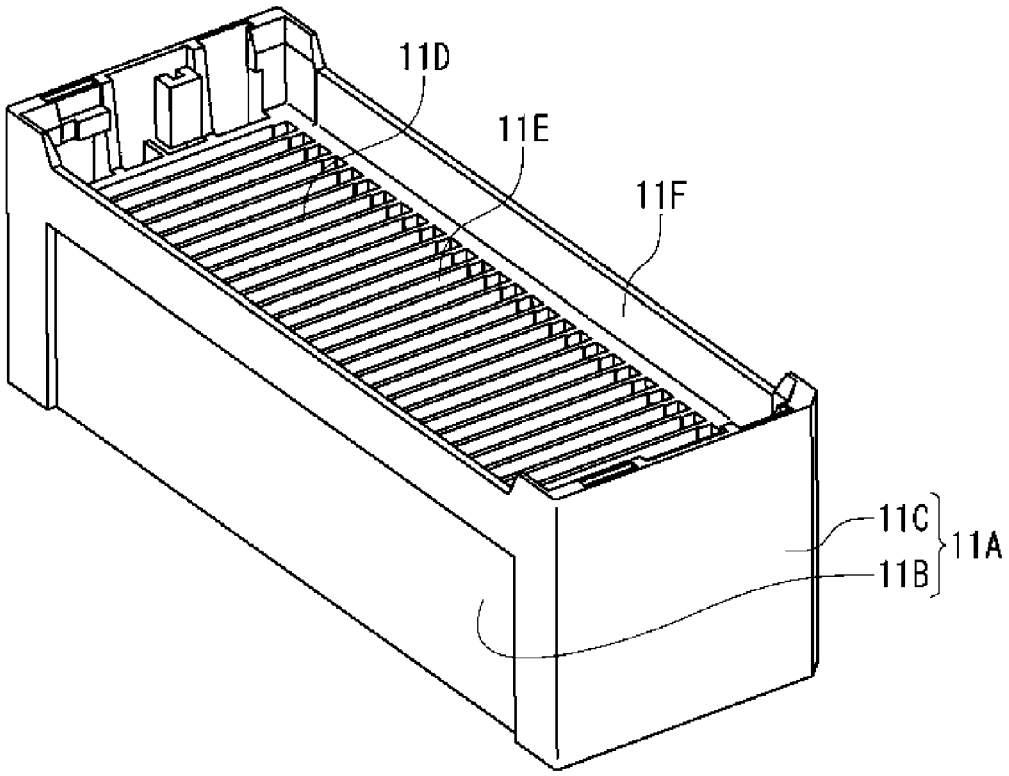
FIG. 3 is a perspective view showing an upper support member of a support member of the intermediate connection electrical connector according to the first embodiment of the present invention.

FIG. 3 is a perspective view showing only the upper support member 11 of the support member 10. The upper support member 11 is made of a conductive material, which is used as an electromagnetic absorbing material, by integrally including a circumferential wall section 11A, which has a quadrilateral frame-like shape when viewed from thereabove and surrounds the plurality of blades 20, and a plurality of restricting sections 11D for positioning the respective blades 20 within certain ranges in the arrangement direction of the blades 20.

The circumferential wall section 11A includes two side wall sections 11B that extend in the longitudinal direction, and two end wall sections 11C that extend in a lateral direction that is perpendicular to the longitudinal direction and connect edges of the two side wall sections 11B. The plurality of restricting sections 11D is formed so as to be arranged at certain intervals in the longitudinal direction within space surrounded by the circumferential wall section 11A. Each restricting section 11D is formed in a flat shape, which has flat surfaces perpendicular to the longitudinal direction, and connects inner wall surfaces of the two side wall sections 11B.

Figure 5:
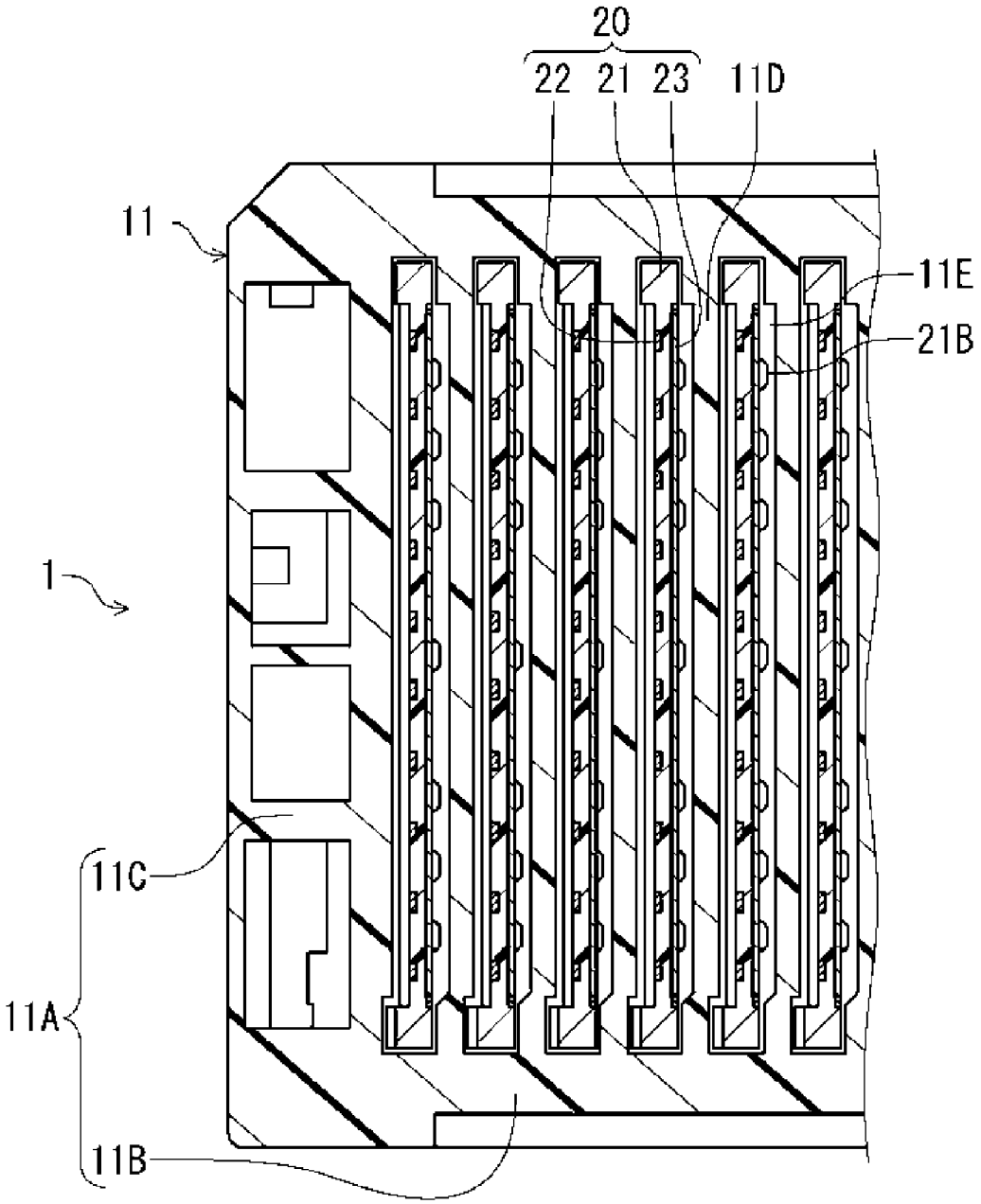
FIG. 5 is an enlarged sectional view showing the intermediate connection electrical connector taken at a surface perpendicular to a connector fitting direction thereof according to the first embodiment of the present invention.

Slit-like spaces formed penetrating between adjacent restricting sections 11D or between the restricting section 11D and the end wall section 11C form blade accommodating spaces 11E to accommodate the blades 20 (See FIG. 5). According to this embodiment, the restricting sections 11D, which are dividing wall sections provided between adjacent blade accommodating spaces 11E, are provided so as to be capable of abutting flat surfaces of the blades 20 to be accommodated in the blade accommodating spaces 11E, so that the blades 20 are positioned within certain ranges in the longitudinal direction.

In addition, on an inner wall surface of each side wall section 11B, upper step-like support sections (not illustrated) for supporting protrusions to be supported 21A (See FIGS. 4(A) and 4(B)) of the blades 20, which will be described below, from thereunder are formed at positions that correspond to the respective blade accommodating spaces 11E in the longitudinal direction and are close to a lower edge in the up-and-down direction.

As shown in FIG. 3, the circumferential wall section 11A extends upward than the upper edges of the restricting sections 11D. The space surrounded by the portion extended upward, i.e. the space that is open upward and connects to the blade accommodating spaces 11E, is formed as an upper receiving section 11F for receiving the mating connector 2 from thereabove. In a state that the blades 20 are accommodated within the blade accommodating spaces 11E, as shown in FIG. 1, upper edge portions of the blades 20 protrude from opening at upper ends of the blade accommodating spaces 11E and are positioned within the upper receiving section 11F.

In the up-and-down direction, the lower support member 12 of the support member 10 has a quadrilateral frame-like shape having the same dimensions as those of the circumferential section 11A of the above-described upper support member 11, and includes two side wall sections 12B that extend in the longitudinal direction and two end wall sections 12C that extend in the lateral direction perpendicular to the longitudinal direction and connect edges of the two side wall sections 12B. On an inner wall surface of each side wall section 12B, at positions that correspond to the respective blade accommodating spaces 11E of the upper support member 11 in the longitudinal direction and are close to an upper end in the up-and-down direction, there are formed lower step-like support sections (not illustrated) for supporting the protrusions to be supported 21A of the blades 20, which will be described below, from thereunder.

The support member 10 is assembled fitting the lower support member 12 to the upper support member 11 from thereunder. As shown in FIG. 1, in a state that the upper support member 11 and the lower support member 12 are fitted to each other, side wall sections of the support member 10 are formed by the side wall sections 11B of the upper support member 11 and the side wall sections 12B of the lower support member 12, and end wall sections of the support member 10 are formed by the side wall sections 11C of the upper support member 11 and end wall sections 12C of the lower support member 12.

In addition, the space surrounded by the lower support member 12, i.e., the space that is open downward under a lower ends of the restricting sections 11D of the support member 10 and connects to the blade accommodating spaces 11E, is formed as a lower receiving section for receiving the mating connector 3 from thereunder. In a state that the blades 20 are accommodated in the blade accommodating spaces 11E, lower ends of the blades 20 protrude from an opening at a lower end of the blade accommodating spaces 11E, and are located within the lower receiving section.

Figure 4:
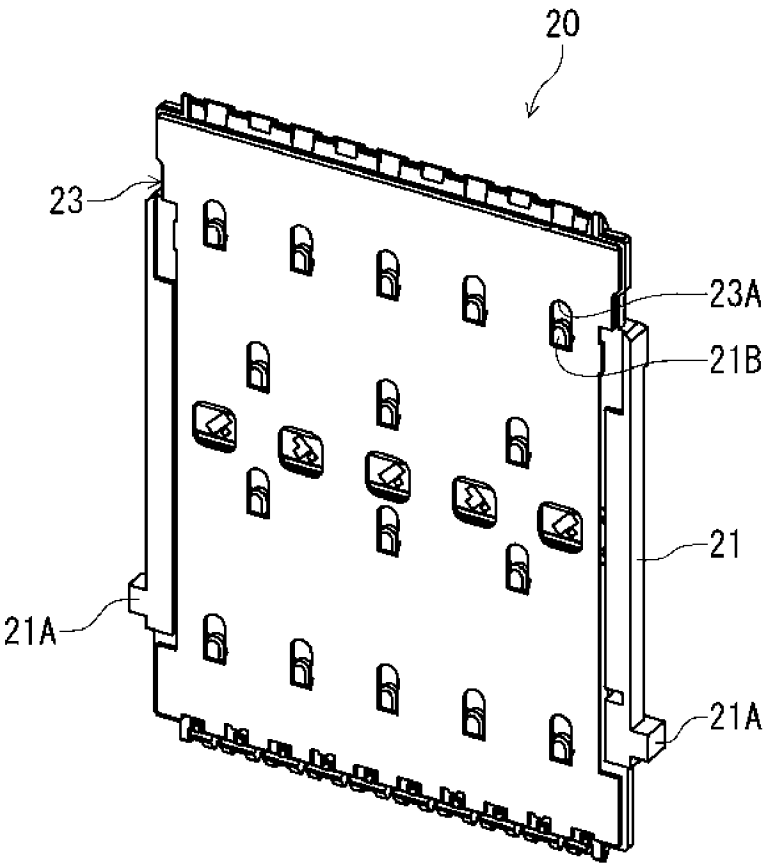
Figure 4:
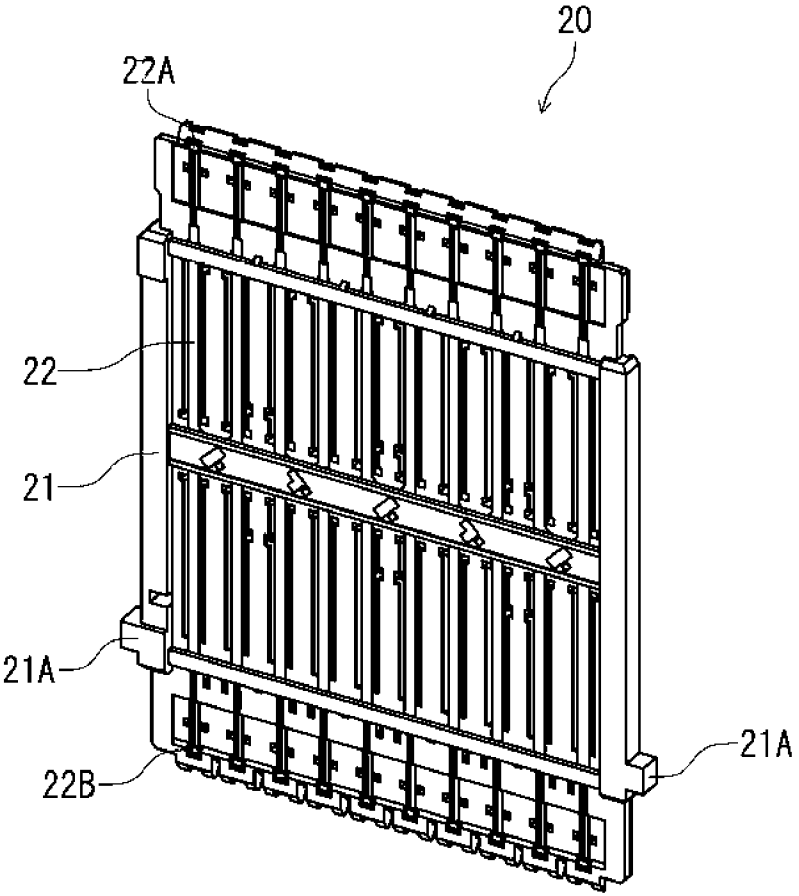

FIGS. 4(A) and 4(B) are perspective views showing one blade 20. FIG. 4(A) shows a surface thereof, on which terminals are arranged, and FIG. 4(B) shows a surface, on which a grounding plate is provided.

As shown in FIGS. 4(A) and 4(B), the blade 20 includes a substrate that is flat and is made of resin; a plurality of terminals 22 that forms a belt-like shape extending in the up-and-down direction and is arranged and held by integral molding on one flat surface of the substrate 21; and a grounding plate 23 as one grounding section made of metal, which is attached to the other flat surface of the substrate 21. Hereunder, one flat surface is referred to as "terminal arranging surface" and the other flat surface is referred to as "grounding plate attaching surface".

As shown in FIGS. 4(A) and 4(B), the substrate 21 has the protrusions to be supported 21A that protrude from positions near a lower end of the both edges extending in the up-and-down direction. As will be described below, the protrusions to be supported 21A are supported from the upper side and the lower side by the upper step-like supporting sections and the lower step-like supporting sections of the support member 10. As shown in FIG. 4(B), the substrate 21 has a plurality of holding protrusions 21B for holding the grounding plate 23 on the grounding plate attaching surface.

As shown in FIG. 4(A), terminals 22 extend over the whole area of the substrate 21 in the up-and-down direction, and each terminal 22 has an upper contact section 22A for contacting with a mating terminal provided in the mating connector 2 and a lower contact section 22B for contacting with a mating terminal provided in the mating connector 3, respectively.

In the first embodiment, a plurality of terminals 22 is arranged at constant intervals in the width direction of the blade 20 (in the left-and-right direction in FIG. 4(A)), and held by the substrate 21 by integral molding. In addition, the terminals 22 that are adjacent to each other and form a pair are formed as paired terminals to transmit differential signals. FIG. 4(A) shows an example, in which 5 pairs of paired terminals are provided in one blade 20.

The grounding plate 23 is made by punching a sheet metal piece. As shown in FIG. 4(B), the grounding plate 23 has a plurality of holding holes 23A for receiving the holding protrusions 21B of the substrate 21 at positions corresponding to the respective holding protrusions 21B. The holding holes 23A are oblong holes that are long in the up-and-down direction than the holding protrusions 21B, and the width dimension of each oblong hole is slightly larger than the holding protrusion 21B at the upper half part thereof and is slightly smaller than the holding protrusion 21B at the lower half part thereof.

Upon attaching the grounding plate 23 to the substrate 21, the holding protrusions 21B of the substrate 21 are brought into upper half parts of the respective corresponding holding holes 23A and the grounding plate 23 is contacted by face to the grounding plate attaching surface of the substrate 21. Then, while keeping the face-to-face contact state, sliding the grounding plate 23 upward, the holding protrusions 21B are pressed in the lower half parts of the holding holes 23A. As a result, as shown in FIG. 4(B), the grounding plate 23 is kept generally covering the whole area of the other flat surface of the substrate 21, and the blade 20 is completed.

In the first embodiment, the relay connector 1 is assembled as described below. First, from under the upper support member 11, insert the blades 20 to the respective blade accommodating spaces 11E. At this time, all the blades 20 are directed so as to have their terminal arranging surfaces face the same sides (See FIG. 5). Next, fitting the lower support member 12 to the upper support member 11 from thereunder, the assembling of the relay connector 1 is completed. Here, the support protrusions 21A of the blade 20 are supported from upper side and lower side thereof between the upper step-like support section of the upper support member 11 and the lower step-like support section of the lower support member 12, and thereby the blades 20 are prevented from coming off from the blade accommodating spaces 11E.

FIG. 5 is a partial sectional view of the intermediate connection electrical connector 1, in which a part of the section taken at a surface perpendicular to the up-and-down direction is enlarged. FIG. 5 shows a state the section at an intermediate point of the upper support member 11 in the up-and-down direction is viewed from thereunder.

As shown in FIG. 5, the plurality of the blades 20 is respectively accommodated within the corresponding blade accommodating spaces 11E, and surrounded by the circumferential wall section 11A and the restricting sections 11D of the upper support member 11. As described above, the support member 10 is made of an electromagnetic wave-absorbing material as a whole. Therefore, even when unnecessary electromagnetic waves irradiated from the terminals 22 of the blades 20 upon use of the relay connector 1 are transmitted to the grounding plates 23 of the blades 20, such unnecessary electromagnetic waves are absorbed by the electromagnetic absorbing material of the circumferential wall section 11A that surround the blades 20 and the restricting sections 11D and are attenuated.

Therefore, it is possible to significantly reduce resonance between the grounding plates 23 that are adjacent to each other. As a result, it is possible to significantly reduce the level of noises picked up from the grounding plates 23 by the terminals 22 of other adjacent blades 20. Here, "significant reduction of resonance" includes prevention of generation of the resonance, and "significant reduction of the level of noises" also includes "reduction of the noise level to 0 (zero).

Next, referring to FIG. 1, configurations of the mating connectors 2 and 3 will be described. Since the mating connectors 2 and 3 have the same configurations, referring to the configuration of the mating connector 2 as necessary, the mating connector 3 will be mainly described.

As shown in FIG. 1, the mating connector 3 includes a housing 31 that generally has a shape of a rectangular parallelepiped; and a plurality of mating terminals that is arranged and held in the housing 31. The housing 31 has an outer shape so as to fit to the lower receiving section of the relay connector 1, and has slits 32, which are open upward and extend in the lateral direction, at positions that correspond to the blades 20 of the relay connector 1 in the longitudinal direction of the housing 31. The slits 32 are formed and arranged in the longitudinal direction.

The plurality of mating terminals is made of strip-like sheet metal pieces that extend in the up-and-down direction, and is formed to extend from the housing 31, with the flat surfaces thereof are perpendicular to the longitudinal direction. Of the two flat surfaces of the dividing wall section (a surface perpendicular to the longitudinal direction) that divides adjacent slits, the mating terminals are provided along the flat surface that faces the terminal arrangement surface of the blades 20 of the relay connector 1 in a state that the connectors are fitted. In addition, the mating terminals are arranged and held in positions corresponding to those of the terminals 22 of each blade 20 in the lateral direction.

The mating terminals can elastically displace in the blade's thickness directions, i.e. longitudinal direction, and corresponding contact sections formed at an upper end side elastically contact with the lower contact sections 22B of the terminals 22 of the blades 20. In addition, the lower parts of mating terminals penetrate a bottom wall of the housing 30 (See a bottom wall 43 of the housing 41 of the mating connector 2), and at the parts protruding from the bottom wall, there are provided solder balls 34 for connecting with a circuit board by soldering (See also solder balls 44 of the mating connector 2). Since the mating connector 2 has the same configuration as the above-described mating connector 3, the explanation will be omitted.

Next, referring to FIGS. 1 and 2, operation of fitting the connectors will be described. First, the mating connectors 2 and 3 are connected by soldering to corresponding circuit units of corresponding circuit boards. Then, as shown in FIG. 1, the mating connector 3 is oriented so that the slits 32 open upward and the relay connector 1 is positioned above the mating connector 3. Then, moving the relay connector 1 downward, the relay connector 1 is fitted to the mating connector 3 (See FIG. 2). At this time, the whole mating connector 3 is accommodated in the lower receiving section of the relay connector 1. In the fitted state, the lower contact sections 22B of the terminals 22 provided in the blades 20 of the relay connector 1 and the corresponding contact sections of the mating terminals provided in the mating connector 3 are electrically connected.

Next, as shown in FIG. 1, the mating connector 2 is oriented so as to have the bottom wall 43 direct upward and brought to above the relay connector 1. Then, moving the mating connector 2 downward, the relay connector 1 and the mating connector 2 are fitted. At this point, as shown in FIG. 2, the whole mating connector 2 is accommodated in the upper receiving section 11F of the relay connector 1. In the fitted state, the upper connecting sections 22A of the terminals 22 provided on the blades 20 of the relay connector 1 and corresponding connecting sections of the mating terminals provided in the mating connector 2 elastically contact to each other to electrically connect to each other. As such, once the operation of fitting the connectors is completed, the mating connectors 2 and 3 electrically connect to each other via the relay connector 1.

Second Embodiment

A second embodiment of the present invention will be explained next. According to the relay connector 1 of the first embodiment, one blade 20 is accommodated in one blade accommodating space 11E. On the other hand, according to the second embodiment, two blades 20 are accommodated in a blade accommodating space 111E, which is a difference in the configuration from that of the first embodiment. Hereunder, referring to FIG. 6, differences from the first embodiment are mainly described. In the description below, reference numerals of parts correspond to those of the first embodiment are indicated with the same reference numerals of the first embodiment but to which "100" is added, and explanation may be omitted.

Figure 6:
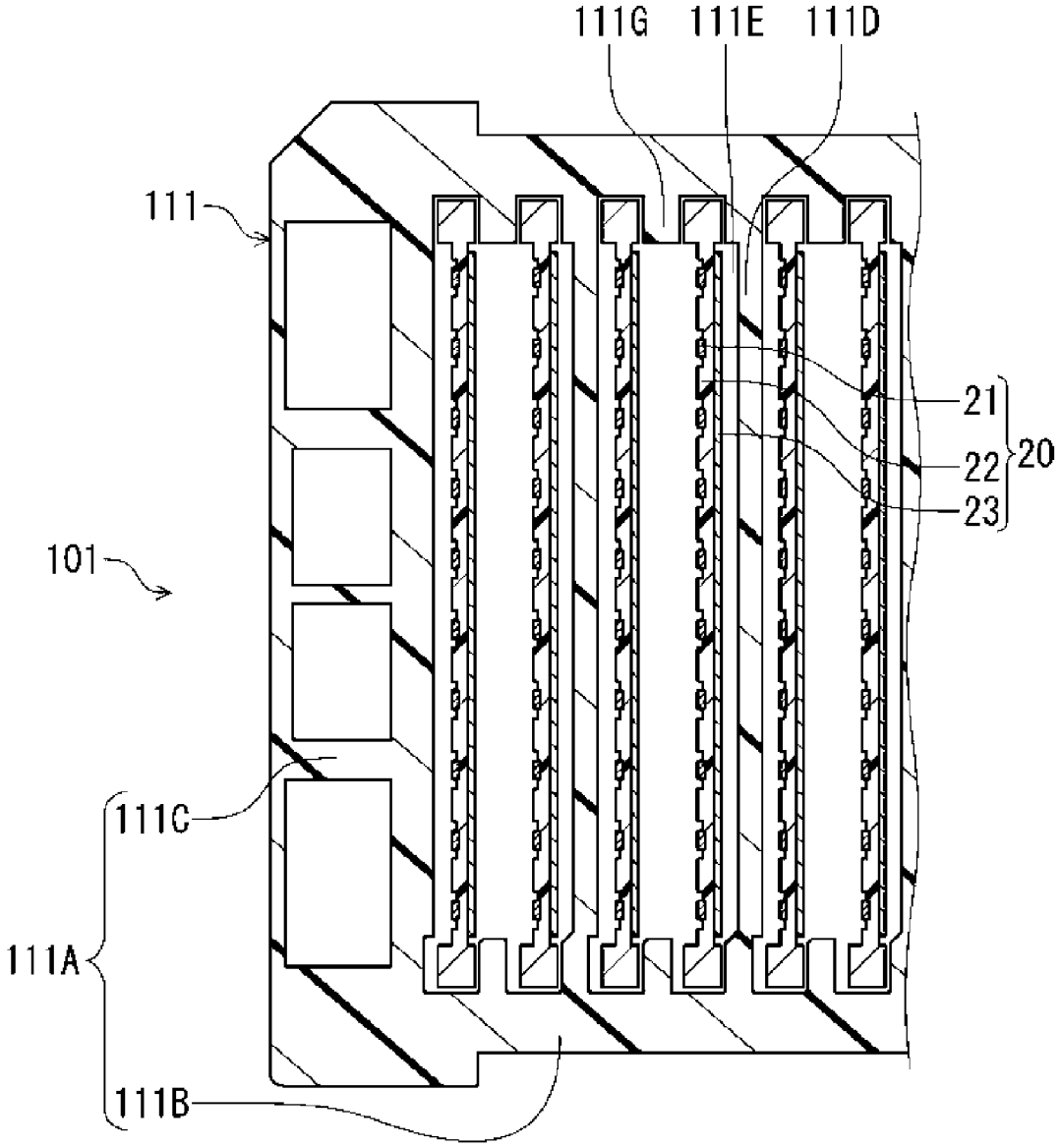
FIG. 6 is an enlarged sectional view showing an intermediate connection electrical connector taken at a surface perpendicular to a connector fitting direction thereof according to a second embodiment of the present invention.

FIG. 6 is a partial sectional view of the intermediate connection electrical connector 101, in which a part of the section taken at a surface perpendicular to the up-and-down direction is enlarged. FIG. 6 shows the section taken at an intermediate point of the upper support member 111 in the up-and-down direction as viewed from thereunder.

As shown in FIG. 6, the upper support member 111 of this embodiment has a shape, such that the restricting sections 11D of the support member 10 of the first embodiment are alternately skipped. In addition, at positions where the restricting sections 111D are skipped in the longitudinal direction of the upper support member 111 (in a left-and-right direction in FIG. 6), there are formed thin protrusions 111G protruding from inner wall surfaces of the side wall sections 111B extending in the up-and-down direction (in a direction perpendicular to the paper surface).

In the second embodiment, the thin protrusions 111G also serve as restricting sections. With the thin protrusions 111G are positioned so as to be capable of abutting both edges (the upper end section and the lower end section in FIG. 6) of the blades 20, the positions of the blades 20 are restricted in the longitudinal directions.

In the second embodiment, similar to the first embodiment, unnecessary electromagnetic waves irradiated from the terminals 22 of the blades 20 and transmitted to the grounding plates 23 are absorbed by the electromagnetic wave-absorbing materials of the surrounding wall section 110 of the support member 110, the restricting sections 111D, and the thin protrusions 111G, and are attenuated. Therefore, it is possible to significantly reduce generation of resonance between the grounding plates 23 and also the level of noises picked up by the terminals 22.

Third Embodiment

A third embodiment of the present invention will be explained next. In the relay connector 1 of the first embodiment, the restricting sections 11D are provided as dividing wall sections that divide the blade accommodating spaces 11E. On the other hand, according to the third embodiment, there is no dividing wall sections provided, and restricting sections are provided as thin protrusions provided on side wall sections, which is different from the first embodiment. Hereunder, referring to FIG. 7, differences from the first embodiment will be mainly described and reference numerals of parts of the support member that correspond to those in the first embodiment will be indicated with the same reference numerals of the first embodiment but to which "200" is added, and the explanation may be omitted.

Figure 7:
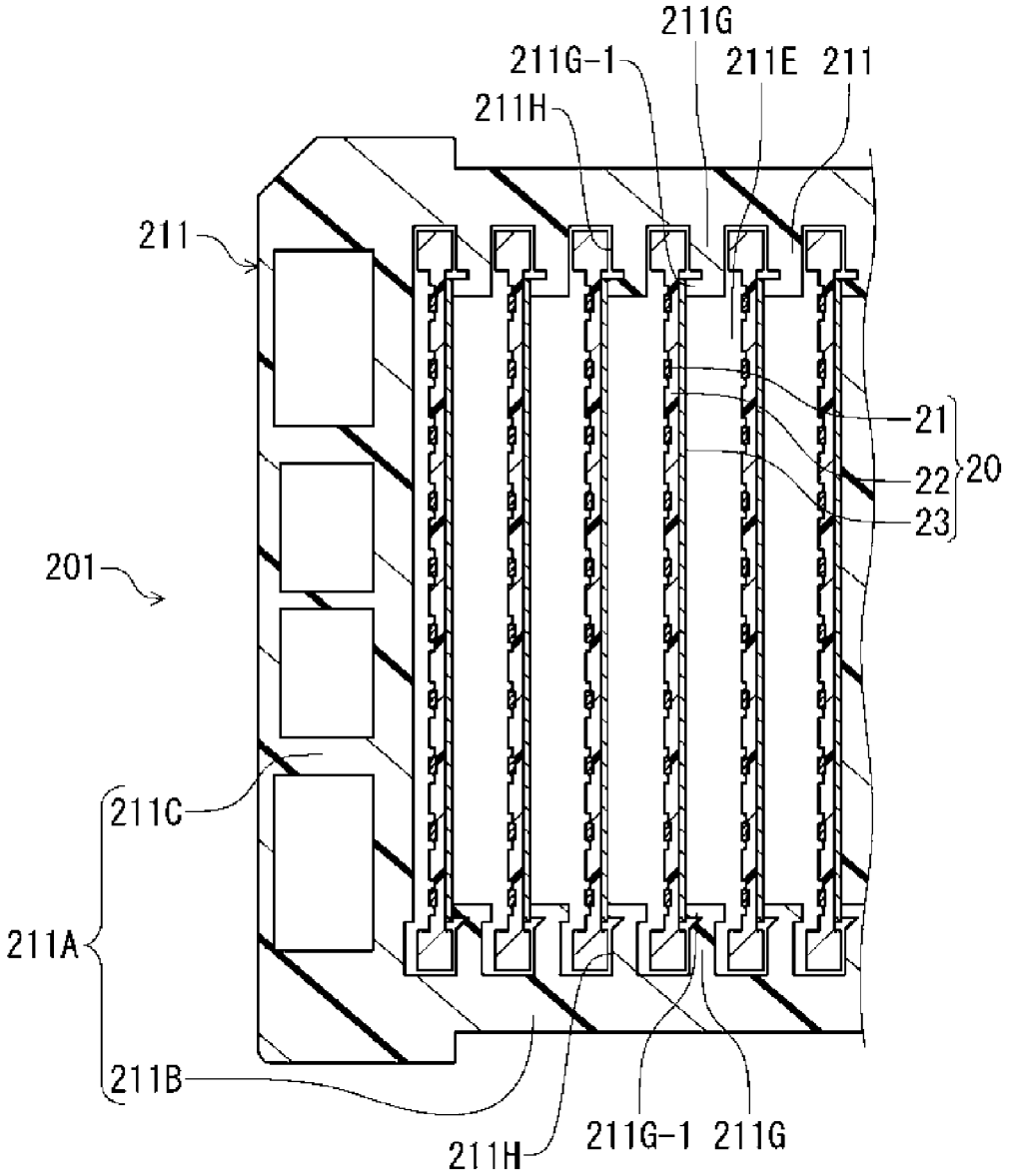
FIG. 7 is an enlarged sectional view showing an intermediate connection electrical connector taken at a surface perpendicular to a connector fitting direction thereof according to a third embodiment of the present invention.

FIG. 7 is a partial sectional view of the intermediate connection electrical connector 201, in which a part of the section taken at a surface perpendicular to the up-and-down direction is enlarged. FIG. 7 shows the section taken at an intermediate point of the upper support member 211 in the up-and-down direction as viewed from thereunder.

As shown in FIG. 7, the support member 210 of this embodiment has a shape such that the restricting sections 11D of the support member 10 in the first embodiment are omitted. In addition, as shown in FIG. 7, on inner wall sections of two side wall sections that face each other, thin protrusions 211G, which are provided as restricting sections that protrude inward in the lateral direction (in the up-and-down direction in FIG. 7) of the support member 210 and extend in the up-and-down direction (in a direction perpendicular to the paper surface of FIG. 7), are formed and arranged at constant intervals in the longitudinal direction (in the left-and-right direction in FIG. 7) of the support member 210. The blades 20 are accommodated such that edges thereof are inserted in grooves 211H, which are formed between thin protrusions 211G that are adjacent to each other.

As shown in FIG. 7, the thin protrusions 211G have abutting sections 211G-1, which are formed at tips thereof in the protruding directions (in the up-and-down direction in FIG. 7) and protrude towards the grounding plates 23 of the blades 20. The thin protrusions 211G abut surfaces of the grounding plates 23 at the abutting sections 211G-1. As such, with abutting of the abutting sections 211G-1 to the grounding plates 23, the positions of the blades 20 are restricted in the longitudinal direction. In other words, the thin protrusions 211G function as restricting sections.

According to the third embodiment, similar to the first and the second embodiments, unnecessary electromagnetic waves irradiated from the terminals 22 of the blades 20 and transmitted to the grounding plates 23 are absorbed by the electromagnetic absorbing material of circumferential wall section of the support member 210 and the thin protrusions 211G and are attenuated. Therefore, it is possible to significantly reduce generation of resonance between the grounding plates 23 and then the level of noises picked up by the terminals 22.

Furthermore, as described above, according to this embodiment, since the thin protrusions 211G contact by face to the grounding plates 23 at the abutting sections 211G-1, it is also possible to absorb the above-described unnecessary electromagnetic waves by the electromagnetic absorbing material also through the contacting portions. Accordingly, it is possible to more securely prevent resonance between the grounding plates and thereby it is possible to enhance the effect of reducing the noise level. Here, according to the present invention, the contact between the thin protrusions 211G and the grounding plates 23 is not essential, and even when they are not in contact, the unnecessary electromagnetic waves are absorbed by the electromagnetic absorbing materials. In addition, according to this embodiment, since the grounding plates 23 of any blades 20 are electrically connected to each other by contact between the thin protrusions 211G and the grounding plates 23, it is achievable to enhance the grounding effect.

Fourth Embodiment

A fourth embodiment of the present invention will be explained next. According to the first embodiment, the intermediate connection electrical connector 1 does not include grounding plates other than the grounding plates 23 of the blades 20. On the other hand, according to the fourth embodiment, in addition to the grounding plates 23, there are provided secondary grounding plates 50, which is different from the first embodiment. Hereunder, referring to FIG. 7, differences from the first embodiment will be mainly described and reference numerals of parts of the support member that correspond to those in the first embodiment will be indicated with the same reference numerals of the first embodiment but to which "300" is added, and the explanation may be omitted.

Figure 8:
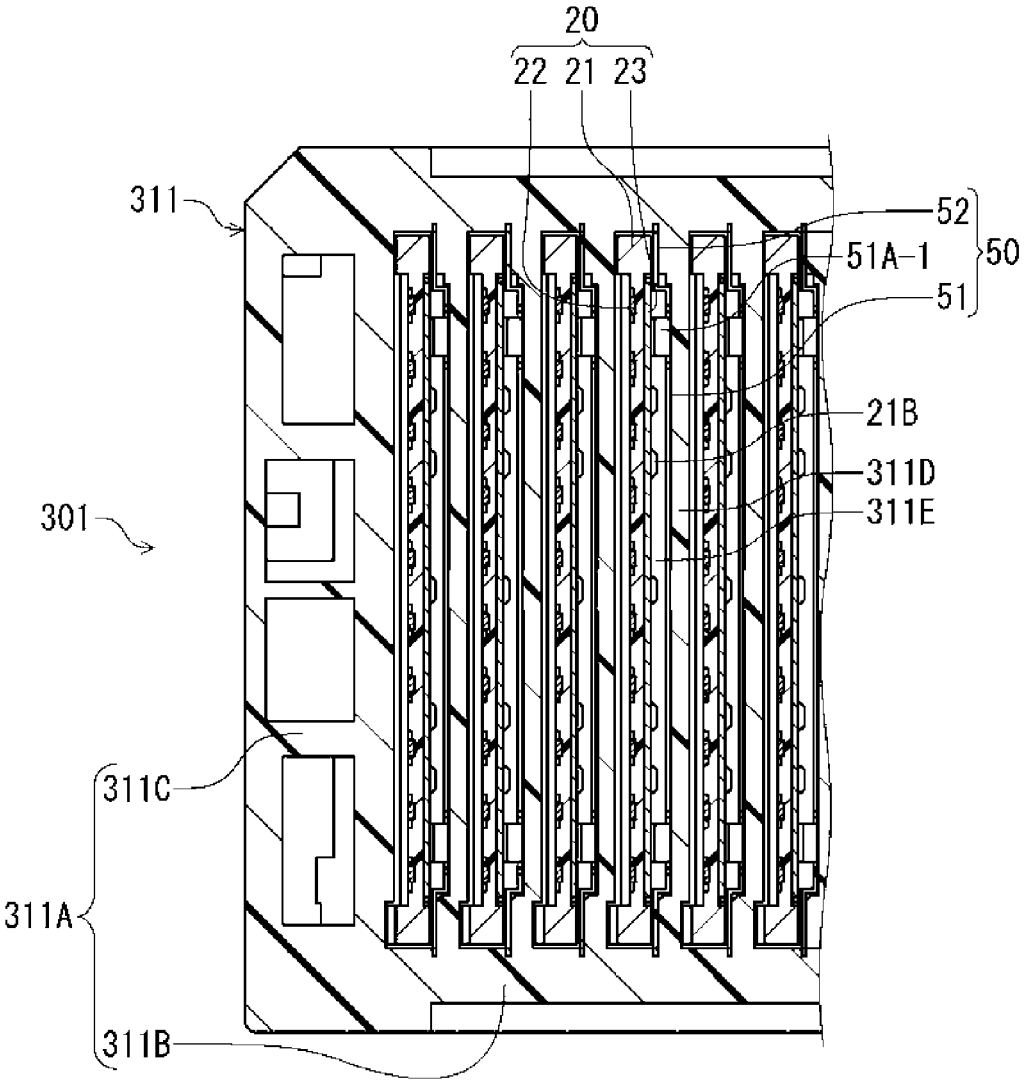
FIG. 8 is an enlarged sectional view showing an intermediate connection electrical connector taken at a surface perpendicular to a connector fitting direction thereof according to a fourth embodiment of the present invention.
Figure 9:
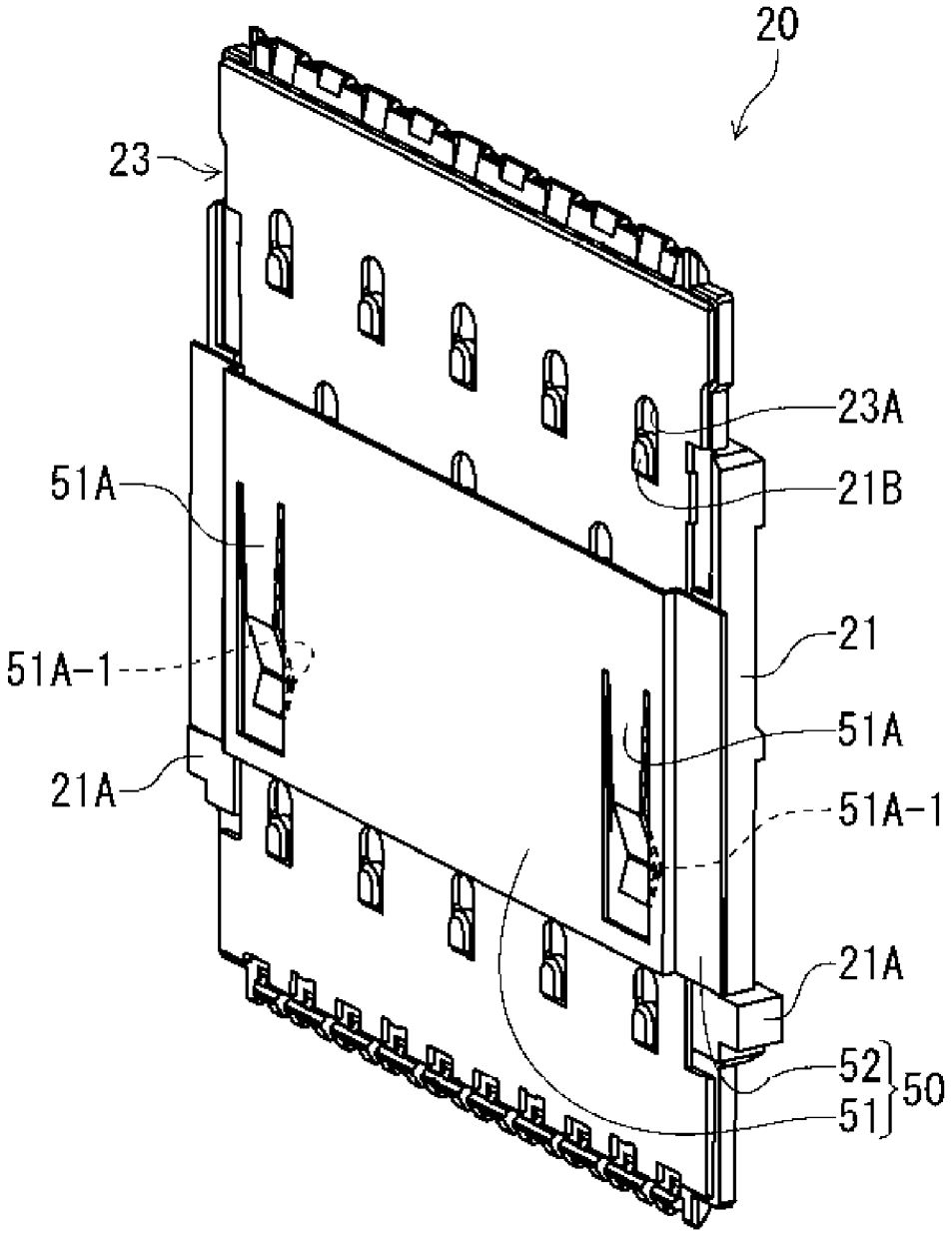
FIG. 9 is a perspective view showing a blade and a secondary grounding plate corresponding to the blade of the intermediate connection electrical connector according to the fourth embodiment of the present invention.

FIG. 8 is a partial sectional view of the intermediate connection electrical connector 301, in which a part of the section taken at a surface perpendicular to the up-and-down direction is enlarged. FIG. 8 shows the section taken at an intermediate point of the upper support member 311 in the up-and-down direction as viewed from thereunder. FIG. 9 is a perspective view of the intermediate connection electrical connector 301, in which one blade 20 and a secondary grounding plate 50 corresponding to the blade 20 are extracted.

According to the fourth embodiment, the relay connector 301 is configured such that a plurality of secondary grounding plates 50 is arranged and held in the relay connector 1 of the first embodiment. As shown in FIG. 8, of the two surfaces of each restricting section 311D, each secondary grounding plate 50 is arranged along a surface of the restricting section 311D, on which the grounding plate 23 of the blade 20 is provided. In other words, the secondary grounding plates 50 face respective corresponding grounding plates 23.

Each secondary grounding plate 50 is formed by punching a sheet metal piece and then bending, and has a main member section 51 that face the grounding plate 23 of the blade 20, and two sections to be held 52 that are provided on both sides of the main member section 51 in the width direction of the secondary grounding plate 50 (in the up-and-down direction in FIG. 8) and are held by the side wall sections 311B. As shown in FIG. 8, a boundary part between the main member section 51 and the section to be held 52 is bent to form a step-like (crank-like) shape (See also FIG. 9).

In addition, as shown in FIG. 9, the main member section 51 has elastic tabs 51A, which are formed to be like cantilevers extending downward near the both side edges of the main member section 51 in the width direction, i.e., at a position near the sections to be held 52, and can elastically displace in the thickness direction by cutting and lifting. On each elastic tab 51A, a contacting protrusion 51A-1 (indicated with a broken line in FIG. 9) that protrudes towards the grounding plate 23 is formed at a lower part thereof by being bent. Each contacting protrusion 51A-1 elastically contacts with the surface of the grounding plate 23 by energizing force (See also FIG. 8).

On inner wall surfaces of the side wall sections 311B of the upper support member 311, there are formed slit-like holding grooves for holding the sections to be held 52 of the secondary grounding plates 50, and the holding grooves extend in the up-and-down direction. As shown in FIG. 9, the sections to be held 52 are pressed in the holding grooves from thereunder, and the secondary grounding plates 50 are held at positions corresponding to the intermediate area of the grounding plates 23 in the up-and-down direction.

According to the fourth embodiment, in addition to the grounding plates 23 of the blades 20, there are provided the secondary grounding plates 50 that elastically contact with the grounding plates 23, so that the grounding function is further reinforced. Moreover, needless to say, the relay connector 301 of this embodiment has the same configuration as that of the relay connector 1 of the first embodiment except having the above-described secondary grounding plates 50, and can provide the above-described effects of the first embodiment.

Furthermore, as described above, according to the fourth embodiment, the sections to be held 52 of the secondary grounding plates 50 are held in the holding grooves of the side wall sections 311B, and thereby the secondary grounding plates 50 and the side wall sections 311B contact to each other. Therefore, it is possible to absorb the unnecessary electromagnetic waves irradiated from the terminals by the grounding plates 23 and the side wall sections 311 through the secondary grounding plates 50, i.e., the electromagnetic absorbing material. Therefore, it is possible to more securely prevent resonance between grounding plates and to enhance the effect of reducing the noise level.

Fifth Embodiment

A fifth embodiment of the present invention will be explained next. According to the first through the fourth embodiments, the upper support member of the support member is integrally formed as one member that includes the circumferential wall section and the restricting sections from an electromagnetic material. On the other hand, according to the fifth embodiment, as will be described, the upper support member is composed of two different types of members, which is different from the first through the fourth embodiments.

Figure 10:
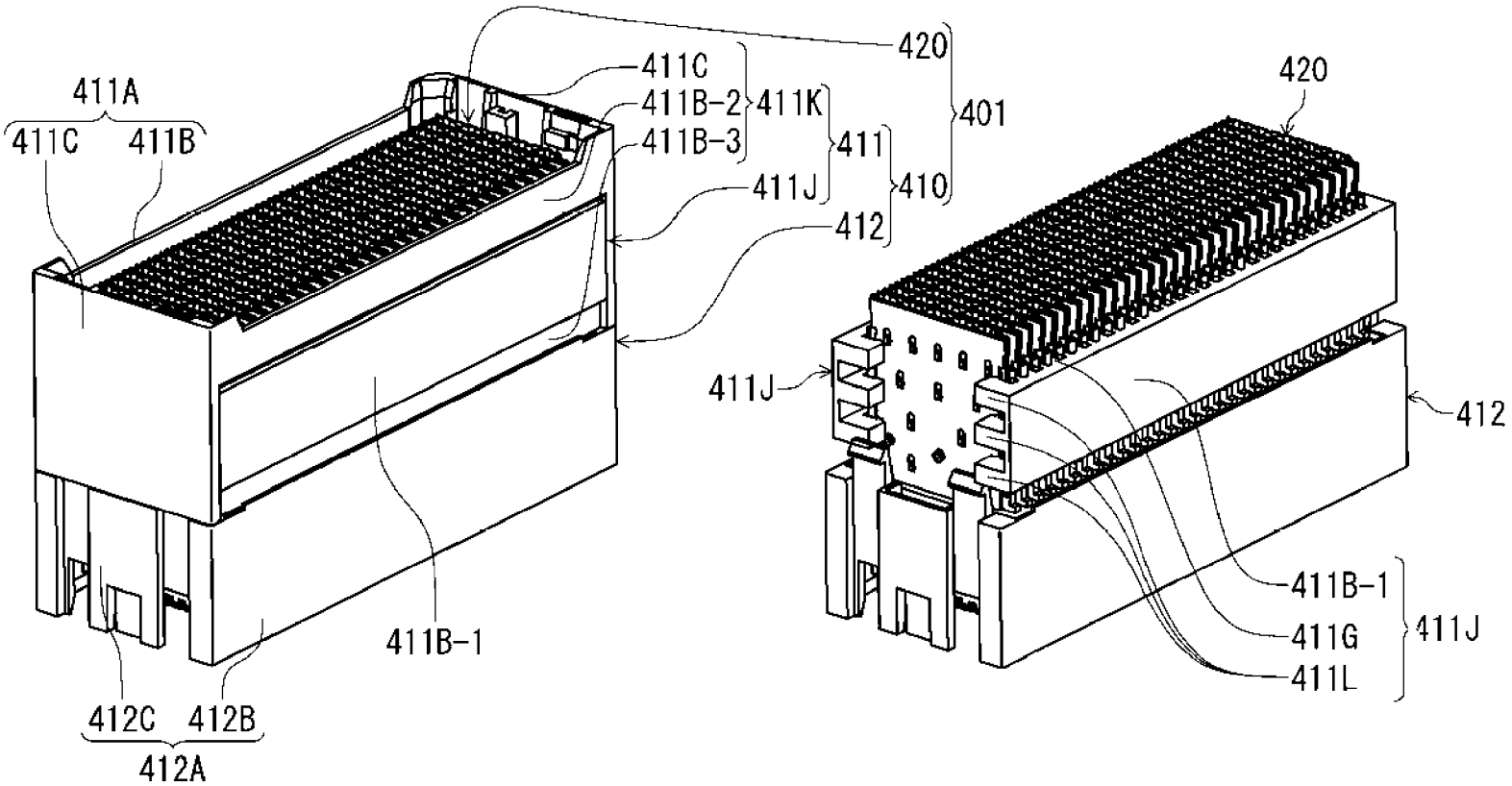

Hereunder, referring to FIG. 10, differences from the third embodiment will be mainly described and reference numerals of parts of the supporting member that correspond to those in the third embodiment will be indicated with the same reference numerals of the third embodiment as those in the third embodiment but to which "200" is added, and the explanation may be omitted.

Figure 11:
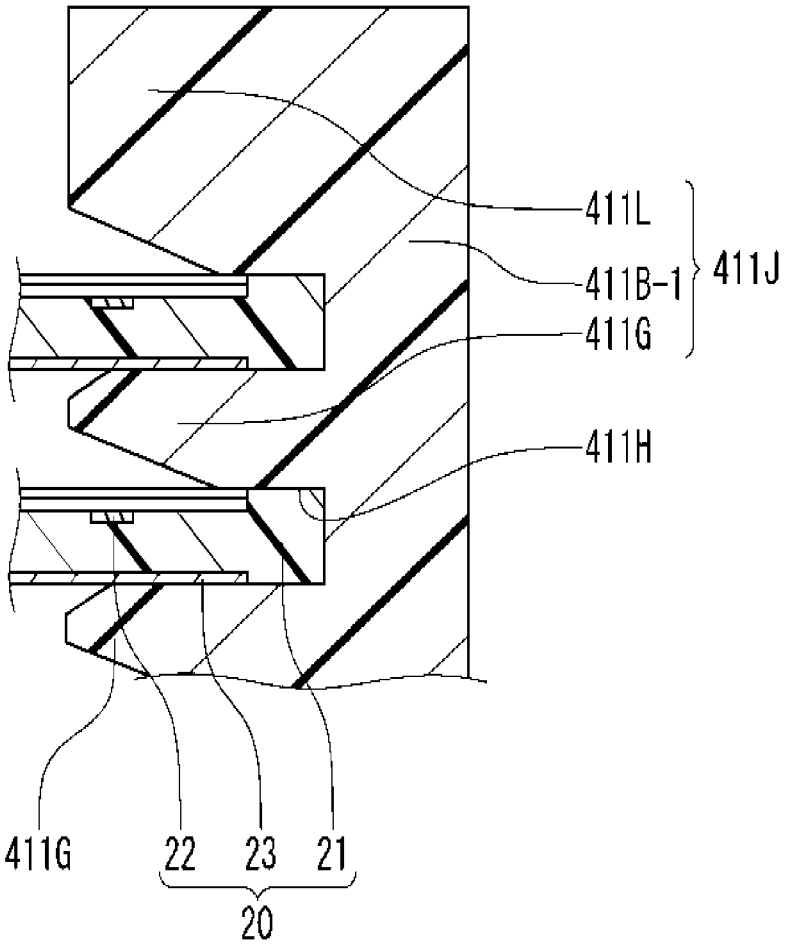
FIG. 11 is an enlarged sectional view showing the intermediate connection electrical connector taken at a surface perpendicular to a connector fitting direction thereof according to the fifth embodiment of the present invention.

FIG. 10(A) is a perspective view showing outer appearance of the intermediate connection electrical connector 401 according to this embodiment, and FIG. 10(B) is a perspective view with a frame member of the upper support member 411 of the intermediate connection electrical connector 401 of FIG. 10(A) is omitted. FIG. 11 is a partial sectional view of the intermediate connection electrical connector 401 of FIG. 10(A), in which a part of the section taken at a surface perpendicular to the up-and-down direction is enlarged. FIG. 11 shows the section taken at an intermediate point of the upper support member 411 in the up-and-down direction as viewed from thereunder.

In the fifth embodiment, the support member 410 has a configuration that the upper support member 211 of the support member 210 of the third embodiment is assembled from two types of members. More specifically, the upper support member 411 of the support member 410 in this embodiment includes two restricting members 411J made from conductive rubber as an electromagnetic absorbing material, and a frame member 411K for holding the two restricting members 411J made from resin that does not have an electromagnetic wave absorbing property (nonconductive resin).

As shown in FIG. 10(B), each restricting member 411J has an intermediate side section 411B-1 that is an intermediate section in the up-and-down direction of the side wall section 411B of the upper support member 411 (See FIG. 10(A)); protrusions to be attached 411L, which are provided on both end sections in the longitudinal direction of the intermediate side sections 411B-1; and a plurality of thin protrusions 411G, which is arranged and formed at constant intervals in the arrangement range of the blades 20 in the longitudinal direction.

In the fifth embodiment, the protrusions to be attached 411L and the thin protrusions 411G protrude inward in the lateral direction of the upper support member 411, and are formed at a plurality of positions (at three positions for the protrusions to be attached 411L in the example of FIG. 10(B)) in the up-and-down direction, corresponding to the attachment holes of the frame member 411K, which will be described below.

In addition, as shown in FIG. 11, at a protruding tip of each thin protrusion 411G, a surface that faces the terminal arrangement surface of the blade 20 is formed as a slanted surface having a gap from the terminal 22, and is configured not to contact with the terminal 22. The restricting members 411J having such configuration are made as one member that is integrally formed to include the intermediate side section 411B-1, the protrusion to be attached 411L, and the thin protrusion 411G as one member from conductive rubber, i.e., electromagnetic absorbing material.

As shown in FIG. 10(A), the frame member 411K has two end walls 411C; upper side sections 411B-2, lower side sections 411B-3, and a plurality of attachment plate sections (not illustrated), which extend in the longitudinal direction and join the two edges of the two end walls 411C. The upper side sections 411B-2 and the lower side sections 411B-3 are positioned near the upper end of and near the lower end of the end walls 411C, respectively. In addition, the two attachment plate sections are provided being away from each other between the upper side section 411B-2 and the lower side section 411B-3 in the up-and-down direction and function as a portion for attaching the restricting members 411J to the frame member 411K.

In the up-and-down direction, between the upper side section 411B-2 and the upper attachment plate section, between the two attachment plate sections, and between the lower attachment plate section and the lower side section 411B-3, extending are holes (not illustrated), and the holes serve as attachment holes (not illustrated), to which the protrusion to be attached 411L of the restricting member 411J and the thin protrusion 411G are pressed. The frame member 411K having such configuration is made as one member from a nonconductive resin that does not have an electromagnetic absorbing property.

Each upper support member 411 is assembled by pressing the attachment protrusions 411L of the restricting member 411J and the thin protrusion 411G into the attachment holes of the frame member 411K from both side in the lateral direction of the frame member 411K. Once the assembling of the upper support member 411 is completed, as shown in FIG. 10(A), the intermediate side section 411B-1 of the restricting member 411J is disposed between the upper side section 411B-2 and the lower side section 411B-3 of the frame member 411K, and the side wall section 411B having one flat side surface is formed from the intermediate side section 411B-1, the upper side section 411B-2, and the lower side section 411B-3. In addition, the plurality of the thin protrusions 411G of the restricting member 411J penetrates the attachment holes of the frame member 411K and protrudes inward in the lateral direction.

Both edges of the blades 20 are pressed in the grooves 411H formed between the thin protrusions 411G that are adjacent to each other, from under the upper support member 411. At this point, as shown in FIG. 11, the thin protrusions 411G contact by face with the grounding plates 23 of the blades 20. In addition, as described above, the thin protrusions 411G do not contact with the terminals 22 of the blades 20. Moreover, similarly to the first through the fourth embodiments, fitting the lower support member 412 to the upper support member 411 from thereunder, assembling of the relay connector 401 is completed.

In the fifth embodiment, similar to the first through the fourth embodiments, unnecessary electromagnetic waves irradiated from the terminals 22 of the blades 20 and transmitted to the grounding plates 23 are absorbed by the conductive rubber of the restricting members 411J and attenuated. Therefore, it is possible to significantly reduce generation of resonance between the grounding plates 23 and the level of noise picked up by the terminals 22.

In addition, since the thin protrusions 411G contact by surface with the grounding plates 23, it is also possible to absorb the unnecessary electromagnetic waves by an electromagnetic wave absorbing material through the contacted portions. Accordingly, it is possible to more securely prevent resonance between the grounding plates 23 and to enhance the effect of reducing the noise level. Furthermore, by the contact between the thin protrusions 411G and the grounding plates 23, the grounding plates 23 of any blades 20 are electrically connected via the restricting members 411J, so that it is possible to improve the grounding effect.

Moreover, similar to the first through the fourth embodiments, even when the thin protrusions 411G and the grounding plates 23 are contacted to each other, unnecessary electromagnetic waves are absorbed and thereby it is possible to reduce the noise level.

According to the fifth embodiment, the upper support member 411 is composed of two types of members, the restricting members 411J and the frame member 411K, and only the restricting members 411J are made of an electromagnetic absorbing material. Therefore, in comparison with when the whole upper support member 411 is made of an electromagnetic material, the amount of the electromagnetic wave-absorbing material to use can be small and it is possible to inexpensively produce the upper support member 411 and in turn the relay connector 401.

In the fifth embodiment, as an electromagnetic wave absorbing material for making the restricting members 411J, conductive rubber is used. Therefore, in the assembling process of the relay connector 411, upon pressing the side edges of the blades 20 into the grooves 411H, the thin protrusions 411G, which form the grooves 411H, tightly contact with the blades 20 and thereby tightly presses the blades 20. As a result, the blades 20 are securely held and will be hardly come off from the support member 411, so that it is possible to easily fit the lower support member 412 to the upper support member 411.

In the fifth embodiment, the restricting members 411J are made of conductive rubber, but the material of the restricting members 411J may be any as long as it is an electromagnetic absorbing material. For example, the restricting members can be made of conductive resin.

In addition, according to the fifth embodiment, two restricting members 411J are provided, but instead, only one restricting member can be provided. In this case, for example, it is possible to provide the above-described restricting member on one side wall side of the upper support member and a side wall and a thin protrusion, which are similar to that of the third embodiment, on the other side wall side.

According to the first and the second embodiments, the grounding plates do not contact with the restricting sections or thin protrusions of the support member, but instead, the grounding plates can be configured to contact with the restricting sections and the thin protrusion, so that it is possible to more securely prevent resonance between the grounding plate similarly to the third through the fifth embodiments and thereby enhance the effect of reducing the noise level.

According to the first through the fifth embodiments, the support member also serves as a housing of the relay connector, but instead, for example, the support can serve as a guide to be accommodated within the housing.

According to the first through the fourth embodiments, the whole support member is formed from an electromagnetic wave-absorbing material, but instead, as in the fifth embodiment, only a part of the support member can be made from an electromagnetic wave-absorbing material and the rest can be formed from a material different from an electromagnetic absorbing material, e.g., nonconductive resin that does not have an electromagnetic wave-absorbing property. In this case, of the side wall sections, when at least a portion that corresponds to the arrangement range of the blades is made from an electromagnetic wave-absorbing material, it is possible to obtain the effect of reducing the resonance of the grounding plates.

According to the first through the fifth embodiments, examples, in which the grounding plates are provided as grounding sections of the blades, are described, but an embodiment of the grounding sections is not limited to those, and for example, the grounding sections can be provided as grounding terminals arranged in the same column as the signal terminals of the blades.

According to the first through the fourth embodiments, both two mating connecting members are electrical connectors and the relay connector is used to connect those connectors. The form to use the relay connector is not limited to this, and for example, one of the two mating connecting members can be a circuit board and the other can be an electrical connector. In addition, both of the mating connecting members can be also circuit members. When the mating connecting member is a circuit board, terminals of blades of the relay connector has connecting sections for connecting by soldering to a corresponding circuit unit of the circuit board at end section on a side that corresponds to the circuit board.

Sixth Embodiment

Figure 12:
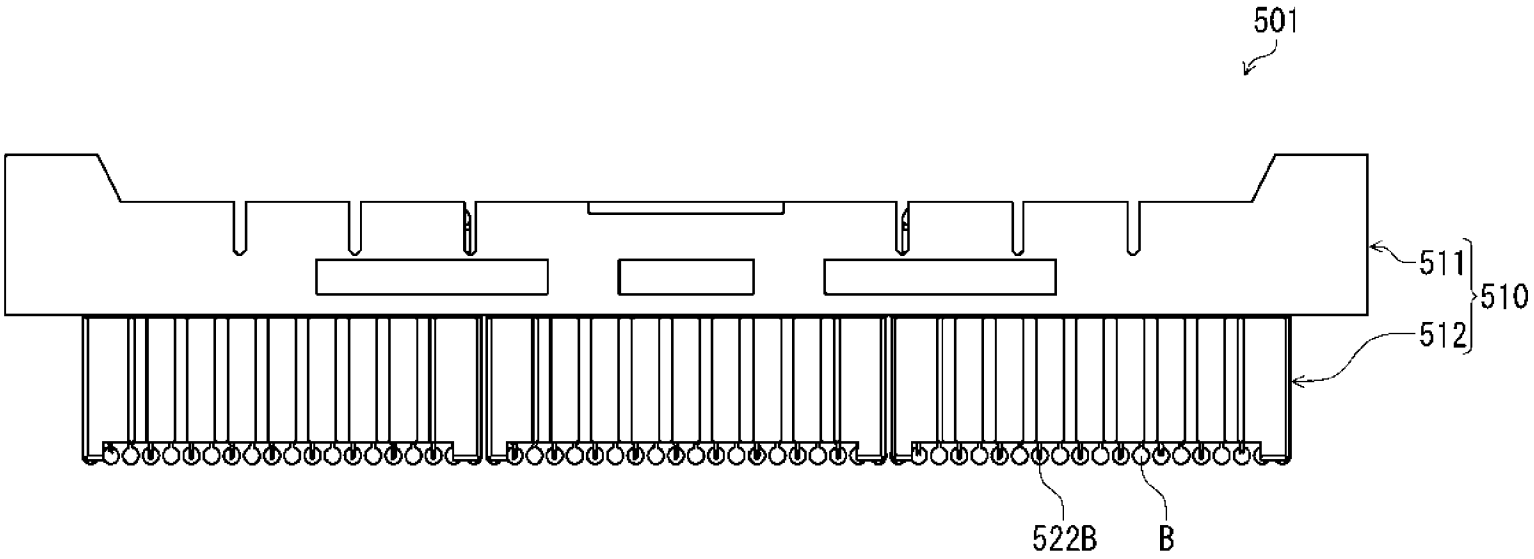
FIG. 12 is a side view showing an intermediate connection electrical connector according to a sixth embodiment of the present invention.

A sixth embodiment of the present invention will be explained next. FIG. 12 shows an intermediate connection electrical connector 501 for fitting and connecting to a mating connector (not illustrated) on an upper side thereof and connecting to a circuit board (not illustrated) on a lower side thereof. In the figure, reference numerals of parts of the support member that correspond to those in the first embodiment will be indicated with the same reference numerals as in the first embodiment but to which "500" is added.

In the sixth embodiment, each terminal of each blade (not illustrated) of the relay connector 501 has a connecting section 522B that extends downward from a lower end of the substrate and a solder ball B is provided at the connecting section 522B.

The disclosure of Japanese Patent Application No. 2013-071526 filed on Mar. 29, 2013, is incorporated in the application by reference.

While the present invention has been explained with reference to the specific embodiments of the present invention, the explanation is illustrative and the present invention is limited only by the appended claims.

What is claimed is:

1. An intermediate connection electrical connector, comprising:

a plurality of blades; and a supporting member for supporting the blades arranged in an arrangement direction, wherein said supporting member includes a surrounding wall portion for surrounding the blades and a regulating portion for positioning the blades, said surrounding wall portion includes a side wall portion and an edge wall portion, said side wall portion is at least partially formed of an electromagnetic wave absorbing material, and said regulating portion is disposed inside the surrounding wall portion to define a blade accommodating space for accommodating the blades, and each of said blades includes a base member formed in a plate shape, a plurality of terminals disposed on one surface of the base member, and a ground plate disposed an opposite surface of the base member.

2. The intermediate connection electrical connector according to claim 1, wherein said regulating portion is disposed as a separation wall portion to define the blade accommodating space as a slit.

3. The intermediate connection electrical connector according to claim 2, wherein said regulating portion is disposed inside the surrounding wall portion to define the blade accommodating space as the slit for accommodating each of the blades.

4. The intermediate connection electrical connector according to claim 2, wherein said regulating portion is disposed inside the surrounding wall portion to define the blade accommodating space as the slit for accommodating two of the blades.

5. The intermediate connection electrical connector according to claim 1, wherein said regulating portion is disposed on an inner surface of the side wall portion as a protruding band portion to form a groove portion for accommodating a side edge of each of the blades.

6. The intermediate connection electrical connector according to claim 1, wherein said supporting member further includes a secondary ground plate facing the ground plate, said secondary ground plate being arranged to contact with the ground plate with an urging force.

7. The intermediate connection electrical connector according to claim 1, wherein said supporting member is configured to be a housing.

8. The intermediate connection electrical connector according to claim 1, wherein said supporting member is configured to be a guide member.

9. The intermediate connection electrical connector according to claim 1, wherein said surrounding wall portion and said regulating portion are integrally formed of an electromagnetic wave absorbing material.

* * * * *